US008397440B1

(12) United States Patent
Ceballos

(10) Patent No.: US 8,397,440 B1
(45) Date of Patent: Mar. 19, 2013

(54) POOL OR SPA SHADE DEVICE

(76) Inventor: Ricardo M. Ceballos, Miami Beach, FL (US)

( * ) Notice: Subject to any disclaimer, the term of this patent is extended or adjusted under 35 U.S.C. 154(b) by 65 days.

(21) Appl. No.: 12/836,973

(22) Filed: Jul. 15, 2010

(51) Int. Cl.
*E04B 1/346* (2006.01)
*E04B 7/16* (2006.01)

(52) U.S. Cl. ..... 52/66; 52/63; 52/64; 135/132; 135/133

(58) Field of Classification Search ..... 52/64, 66, 52/68, 72, 69, DIG. 14; 135/133, 132, 143
See application file for complete search history.

(56) References Cited

U.S. PATENT DOCUMENTS

| | | | | |
|---|---|---|---|---|
| 4,163,295 | A | 8/1979 | Schutz | |
| 4,246,663 | A | 1/1981 | Aragona et al. | |
| 4,417,597 | A | 11/1983 | Montgomery | |
| 5,004,001 | A | 4/1991 | Bouchard | |
| 5,010,939 | A * | 4/1991 | King | 160/84.07 |
| 5,026,109 | A | 6/1991 | Merlot, Jr. | |
| D336,960 | S | 6/1993 | Bedell | |
| 5,625,982 | A * | 5/1997 | Foote | 52/64 |
| 5,680,893 | A | 10/1997 | Neer | |
| 5,746,237 | A * | 5/1998 | Arnic | 135/88.06 |
| 6,065,252 | A * | 5/2000 | Norsen | 52/66 |
| 6,209,149 | B1 | 4/2001 | Song et al. | |
| 6,349,732 | B1 * | 2/2002 | Cooper | 135/133 |
| 6,607,002 | B2 | 8/2003 | Reese | |
| 7,013,904 | B2 * | 3/2006 | Kofler | 135/132 |
| 7,051,481 | B2 * | 5/2006 | Delavega et al. | 52/66 |

* cited by examiner

*Primary Examiner* — William Gilbert
*Assistant Examiner* — Chi Q Nguyen

(57) ABSTRACT

A pool shade device featuring two motor housings disposed on opposite sides of the pool, wherein each motor housing comprises a motor and a set of gears; a plurality of arcs covered with a cover component for shade, each arc having a first end operatively connected to a first motor and a second end operatively connected to a second motor, wherein the cover component can move between an extended position wherein the cover component is fanned over the pool or the spa and a storage position wherein the cover component is collapsed atop an edge of the pool or spa; wherein when the motors are activated, the motors cause the arcs to move between the extended position and the storage position.

5 Claims, 3 Drawing Sheets

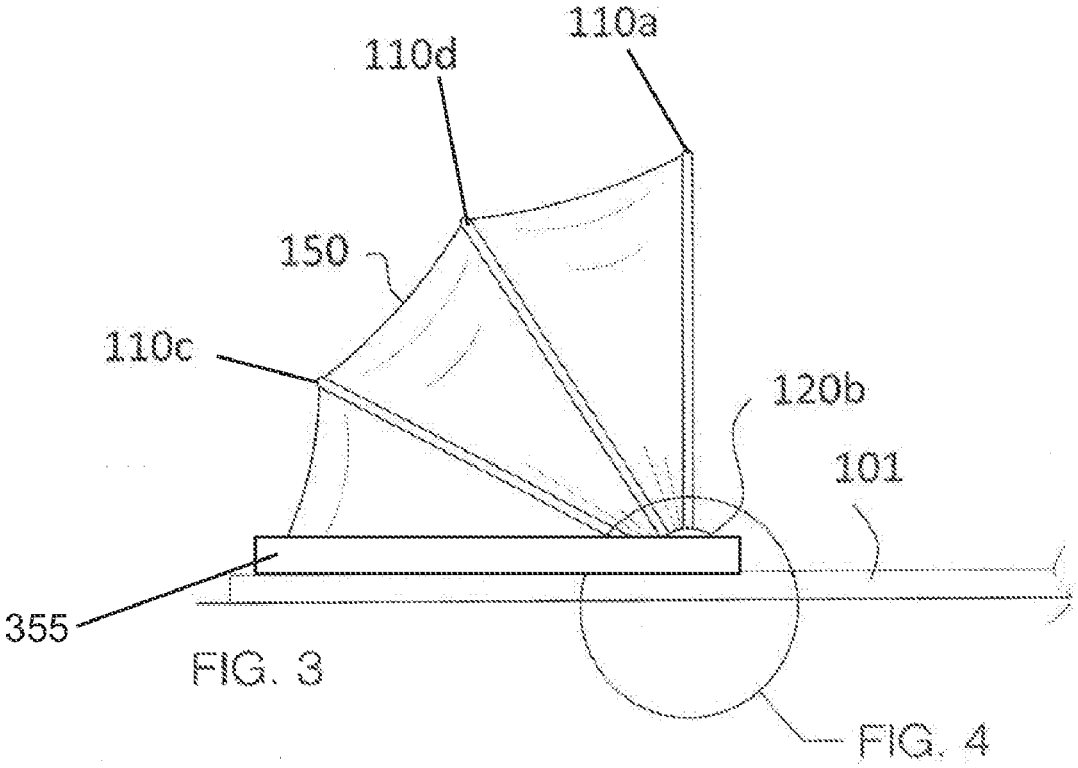
110a
110d
150
110c
120b
101
355
FIG. 3
FIG. 4
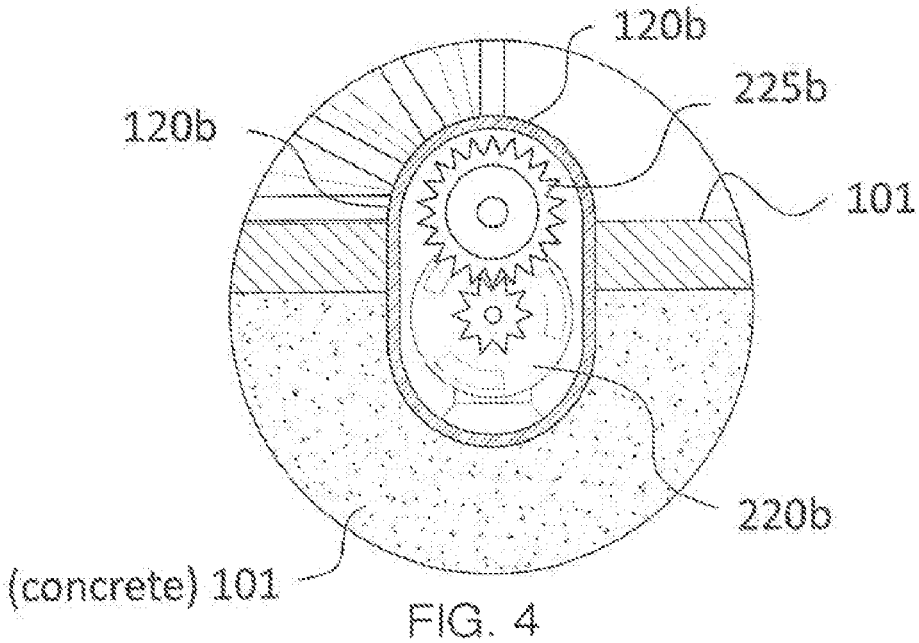
120b
225b
120b
101
220b
(concrete) 101
FIG. 4

POOL OR SPA SHADE DEVICE

FIELD OF THE INVENTION

The present invention is directed to a device for covering a pool or spa to provide privacy or protection from the sun.

BACKGROUND OF THE INVENTION

Swimmers using an outdoor pool are at risk of sunburn due to exposure to the sun. The present invention features a pool shade device for providing privacy to a user and/or protecting a user from the sun while in a pool (or spa). The pool shade device of the present invention is designed to fan out over the pool to provide shade and/or privacy to the user. The pool shade device is retractable and/or collapsible via a motorized mechanism.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 3 is a side view of the pool shade device of FIG. 1.

FIG. 4 is a cross sectional view of the pool shade device of FIG. 4.

DESCRIPTION OF PREFERRED EMBODIMENTS

Figure 1:
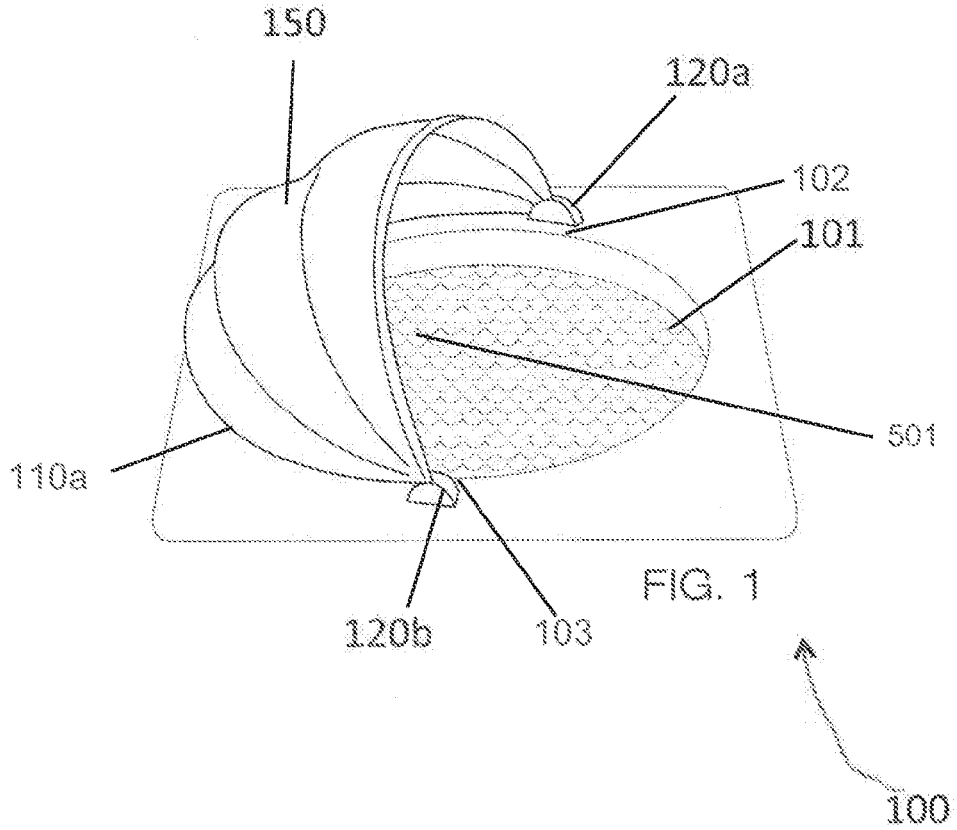
FIG. 1 is a first perspective view of the pool shade of the present invention, wherein the cover component is in the extended position.
Figure 2:
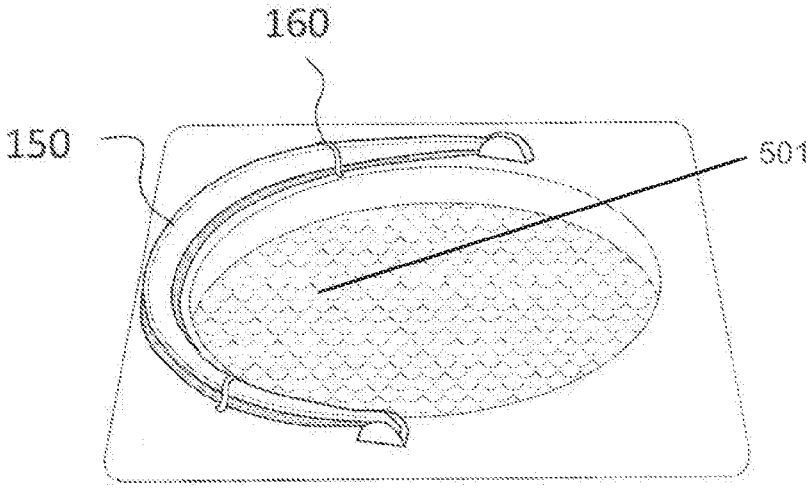
FIG. 2 is a second perspective view of the pool shade of the present invention, wherein the cover component is in the storage position.
Figure 5:
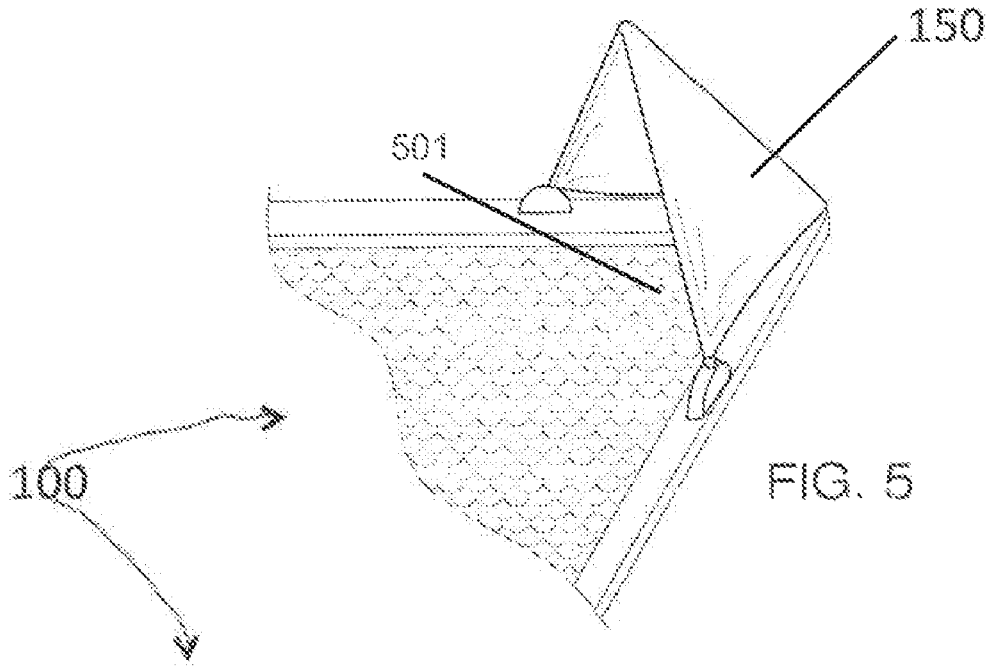
FIG. 5 is a perspective view of an alternative embodiment of the pool shade device of the present invention.
Figure 6:
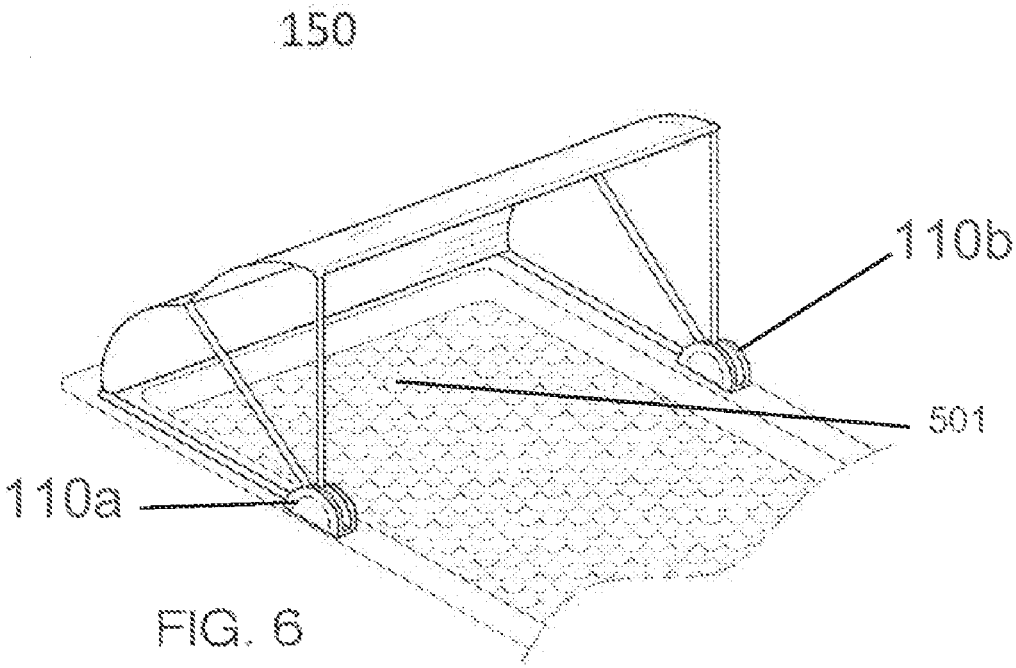
FIG. 6 is a perspective view of an alternative embodiment of the pool shade device of the present invention.

Referring now to FIGS. 1-6, the present invention features a pool shade device 100 for providing privacy to a user and/or protecting a user from the sun while in a pool (or spa). The pool shade device 100 of the present invention is designed to fan out over the pool to provide shade and/or privacy to the user. The pool shade device 100 is retractable and/or collapsible via a motorized mechanism.

The pool shade device 100 of the present invention comprises a corner section 501 of a pool or spa 101, wherein the corner section 501 has a first side 102 and an opposing side 103, a first motor housing 120*a* and a second motor housing 120*b*, the motor housings being installed in opposite sides of a pool 101 such that the first motor housing 120*a* is installed on said first side 102 and second motor housing 120*b* is installed on said opposing side 103. The device of the present invention further comprises a first arc 110*a* having a first end and a second end and a second arc 110*b* having a first end and a second end. The first ends of the arcs are each operatively connected to the first motor housing 120*a* and the second ends of the arcs are each operatively connected to a second motor housing 120*b*. In some embodiments, the device 100 comprises additional arcs in between the first and second arcs, for example a third arc 110*c* and a fourth arc 110*d* (see FIG. 3).

A cover component 150 (e.g., tarp, fabric, etc.) is attached to the first arc 110 and the second arc 110*b*, similar to how a cover component is attached to a plurality of arcs of a baby carriage cover or of a convertible's collapsible top, which are well known to one of ordinary skill in the art. The cover component 150 can move between an extended position (see FIG. 1) and a storage position (see FIG. 2) by moving the arcs apart and over the pool 101.

In some embodiments, the cover component 150 can be secured in the storage position via securing means 160. In some embodiments, the securing means comprises a hook mechanism, a snap mechanism, a hook-and-loop mechanism, a tie mechanism, a clip mechanism, the like, or a combination thereof.

Referring now to FIG. 4, the motor housings 120 function to move the cover component 150 between the extended position and the storage position. A first motor 220*a* is disposed in the first motor housing 120*a* and a second motor 220[a]b is disposed in the second motor housing 120*b*. The first motor 220*a* is operatively connected to a first set of gears 225*a*, which are operatively connected to the first ends of the arcs. The second motor 220*b* is operatively connected to a second set of gears 225*b*, which are operatively connected to the second ends of the arcs. When activated, the first and second motors are coordinated to move their respective sets of gears, which causes the arcs to move in a first direction or second direction according to the movement of the gears. When the cover component 150 is moved to the extended position, it is fanned out over the pool 101 or spa. In some embodiments, the pool shade device of the present invention comprises a remote control for manipulating the motor housings 120. Remote controls 320 are well known to one of ordinary skill in the art.

In some embodiments, the pool shade device 100 of the present invention may be used on a pool or a spa. In some embodiments, the pool shade device 100 is opened to cover the entire pool or spa, or a section of the pool or spa.

The pool shade device 100 may be constructed from a variety of materials, in a variety of shapes, and in a variety of colors and/or styles.

In some embodiments, the pool shade further comprises a storage compartment 355. In some embodiments, the storage compartment is similar to the storage compartments currently used for storing retractable roofs of convertible cars.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A pool shade system for a pool or a spa, said system consisting of:

(a) a corner section of a pool or spa, wherein the corner section has a first side and a second side;

(b) a first motor housing and a second motor housing, the first motor housing being installed on the first side and second motor housing being installed on the second side of the corner section of the pool or the spa;

(c) a first motor disposed in the first motor housing, the first motor being operatively connected to a first set of gears disposed in the first motor housing;

(d) a second motor disposed in the second motor housing, the second motor being operatively connected to a second set of gears disposed in the second motor housing;

(e) a first arc having a first end and a second end, wherein the first end of the first arc is operatively connected to the first set of gears in the first motor housing and the second end of the first arc is operatively connected to second set of gears in the second motor housing;

(f) a second arc having a first end and a second end, wherein the first end of the second arc is operatively connected to the first set of gears in the first motor housing and the second end of the second arc is operatively connected to the second set of gears in the second motor housing;

(g) a cover component attached to the first arc and to the second arc, the cover component can move between an extended position wherein the cover component is fanned over the corner section of pool or the spa and a storage position wherein the cover component is collapsed atop an edge of the pool or spa; and (h) a storage compartment, wherein the storage compartment is for storing the collapsed pool shade;

wherein when the first motor and second motor are activated, the motors cause the arcs to move between the extended position and the storage position.

2. The pool shade device of claim 1 further comprising a third arc and a fourth arc disposed in between the first arc and the second arc.

3. The pool shade device of claim 1, wherein the cover component is a cloth or a tarp.

4. The pool shade device of claim 1, wherein the cover component can be secured in the storage position via a securing means.

5. The pool shade device of claim 4, wherein the securing means comprises a hook mechanism, a snap mechanism, a hook-and-loop mechanism, a tie mechanism, a clip mechanism, or a combination thereof.

* * * * *